United States Patent [19]

Hinkel et al.

[11] 4,336,619

[45] Jun. 29, 1982

[54] HAND WASHER AND DRIER MOUNTING STRUCTURE

[75] Inventors: Lester H. Hinkel, Benton Harbor; Robert M. Chandler, St. Joseph, both of Mich.

[73] Assignee: Whirlpool Corporation, Benton Harbor, Mich.

[21] Appl. No.: 93,905

[22] Filed: Nov. 13, 1979

Related U.S. Application Data

[63] Continuation of Ser. No. 866,176, Dec. 30, 1977, abandoned.

[51] Int. Cl.[3] ..... E03C 1/04; E03C 1/32; A47K 1/04; A47K 10/48

[52] U.S. Cl. ..... 4/619; 4/626; 4/628; 4/630; 4/638; 4/647; 34/90; 312/228

[58] Field of Search ..... 4/191, DIG. 7, 619, 4/620, 624–626, 628, 630, 638, 643, 647–649, 653, 661, 443, 517, 631; 312/228; 52/34, 35; 248/221.1, 221.3, 224.4; 34/90, 197

[56] References Cited

U.S. PATENT DOCUMENTS

| | | | |
|---|---|---|---|
| 1,494,883 | 5/1924 | Bassette | 4/638 |
| 1,765,915 | 6/1930 | Haase | 4/628 X |
| 2,130,196 | 9/1938 | Sakier | 4/630 |
| 2,192,383 | 3/1940 | Krolop | 4/626 |
| 2,281,370 | 4/1942 | Morrison et al. | 4/638 |
| 2,328,129 | 8/1943 | Earle | 34/90 |
| 2,504,740 | 4/1950 | Siegel | 34/90 X |
| 2,767,407 | 10/1956 | Weiss | 4/653 |
| 3,065,473 | 11/1962 | Sporck et al. | 4/626 |
| 3,975,781 | 8/1976 | Klimboff et al. | 4/647 |
| 4,072,157 | 2/1978 | Wines, Jr. et al. | 4/625 |

FOREIGN PATENT DOCUMENTS

| | | | |
|---|---|---|---|
| 2360521 | 6/1975 | Fed. Rep. of Germany | 4/619 |
| 1185573 | 3/1970 | United Kingdom | 4/443 |

OTHER PUBLICATIONS

RAS (Rohr Armatur, Sanitär Heizung) Oct. 1970, p. 506.

*Primary Examiner*—Stuart S. Levy
*Attorney, Agent, or Firm*—Wegner, McCord, Wood & Dalton

[57] ABSTRACT

A hand washing and drying device having a recessed bowl defining a hand washing and drying space. Drying structure is provided including an air moving device which is mounted to the bowl. The air moving structure further includes an outlet opening to within the drying space defined by the recessed bowl to provide an improved utilization of the drying air provided by the air moving structure. The hand washing and drying device also includes a water tank mounted to the bowl. The device may include a housing removably enclosing the bowl and components carried thereby. A wall hanger may be provided for removably mounting the housing in providing a wall-mounted installation of the device.

12 Claims, 9 Drawing Figures

FIG. 6
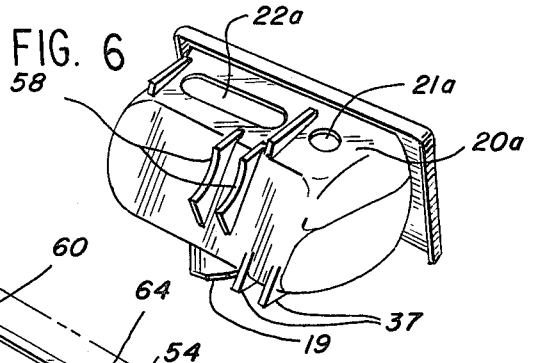
FIG. 9
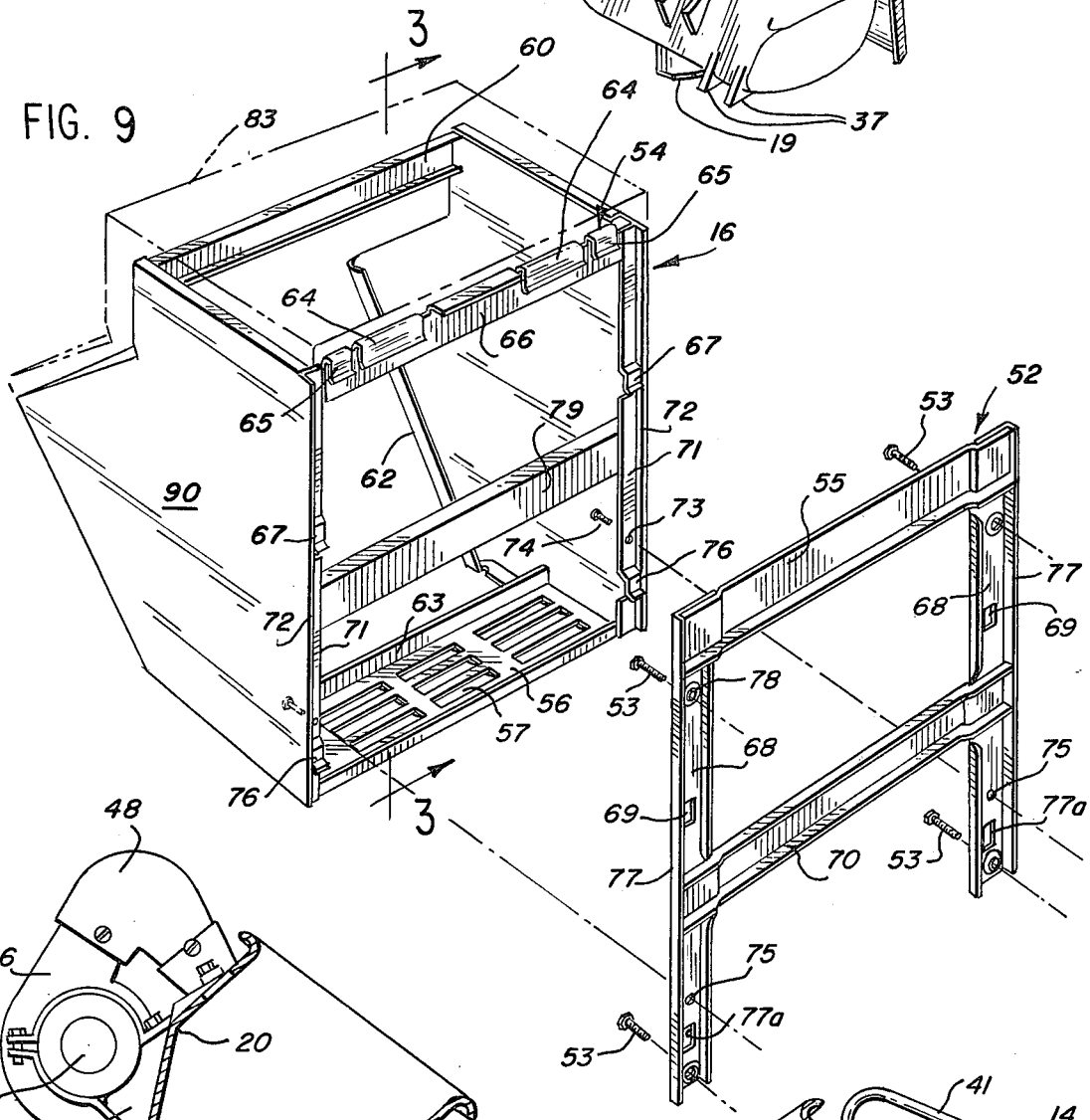
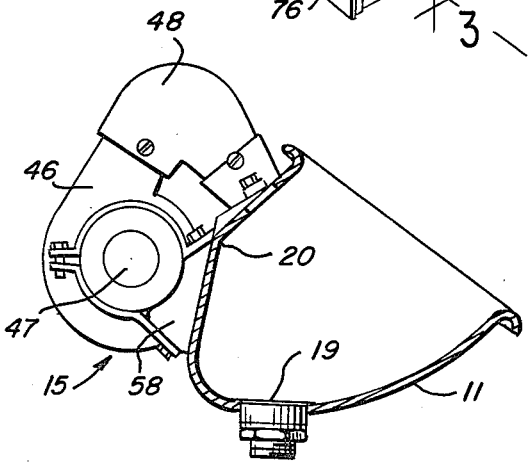
FIG. 8
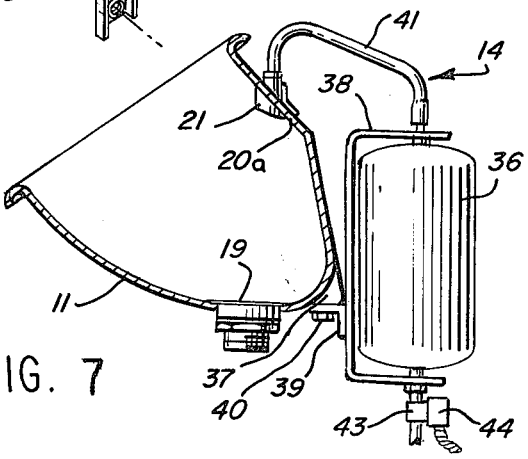
FIG. 7

HAND WASHER AND DRIER MOUNTING STRUCTURE

This is a continuation of application Ser. No. 866,176, filed Dec. 30, 1977, now abandoned.

BACKGROUND OF THE INVENTION

1. Field of the Invention

This invention relates to lavatories and particularly to an automatic hand washing and drying device.

2. Description of the Prior Art

The use of conventional lavatory sinks with adjacent towel or forced air hand drying means in public washrooms and the like is well known. A number of automatic devices have been developed for use in carrying out such hand washing and drying operations.

More specifically, as shown in U.S. Pat. No. 1,765,915 of Oscar Haase, an automatic apparatus for providing water, soap, hot air, and perfume for use in a hand washing and drying operation is illustrated. The apparatus is coin-operated so as to provide preselected times of delivery during the different delivery operations. Illustratively, the liquid soap is discharged for approximately five seconds, the washing water is delivered for approximately 20 seconds, and the drying air is delivered for approximately 40 seconds. The perfume may be delivered in the relatively short time of approximately three seconds. The apparatus is contained in a casing and thus is self-contained independently of any bowl or other means defining a hand washing and drying space. The delivery ducts are defined by a common discharge pipe aimed directly downwardly from the bottom of the casing. However, no bowl is provided for performing the hand washing and drying operation.

In U.S. Pat. No. 2,192,383 of Walter W. Krolop, a lavatory is shown including a hand washing bowl. A water-containing tank and liquid soap-containing tank are built into an upper portion of a cabinet partially enclosing the bowl. A water outlet is mounted in the upper portion of the bowl with a soap dispenser mounted to extend forwardly of the water outlet. A heater, such as a kerosene heater, is provided within the cabinet for heating the hand washing water in the tank. The water outlet is aimed parallel to the upper rim of the bowl. The soap dispenser is actuated by the user's hands within the bowl space, and the hot water delivery is effected by means of operation of a foot treadle engaged by the user's foot during the hand washing operation. No hand drying structure is included in the Krolop lavatory.

William L. Morrison et al. disclosed in U.S. Pat. No. 2,281,370 a combination washroom fixture having a conventional cabinet-mounted sink provided with hot and cold water faucets. The cabinet is filled with hot air heated by a heating coil and a blower is provided therein having a discharge flexible tube extending upwardly from a rear apron portion of the sink permitting the nozzle thereof to be pulled out to a desired position such as for drying the user's hands or hair. A foot pedal is disclosed for operating the drier fan motor. The hot air in the cabinet is used to heat the room in which the device is mounted at times when the air is not being delivered through the discharge nozzle. The outlets to the room are closed by a suitable control device when it is desired to use the discharge nozzle. In the normal position, the hot air discharge nozzle is located above the bowl of the sink and is aimed directly forwardly over the top of the sink, with the flexible hose connection thereof permitting selective positioning of the nozzle as desired by the user.

In U.S. Pat. No. 2,328,129, Guyon L. C. Earle shows a drier arrangement for dishes wherein heated air is delivered to a compartment above the rear of a sink so as to dry dishes or the like placed in the compartment after having been washed in the sink.

Louis L. Siegel, in U.S. Pat. No. 2,504,740, shows a combination soap-dispensing device and hand drier which are mounted in a housing adapted to be attached to a wall by suitable brackets so as to be disposed immediately above or adjacent a washbowl. Heated air is directed in a first path for drying the user's hands and in a second path for drying soap in the soap container. The device includes granulating means for providing granulated particles of soap from a bar provided within the soap dispenser.

Other prior art disclosures showing structures which may be used for hand washing and drying operations include the following U.S. Pat. Nos.:

| U.S. Pat. No. | Inventor | Title |
|---|---|---|
| Des.124,423 | Wilkinson | Design for a Lavatory with Water Heater |
| 906,247 | Mahoney | Receptacle and Support Therefor |
| 1,494,883 | Bassette et al | Lavatory Fixture |
| 2,786,211 | Culver, Jr. | Self-Serving Sink |
| 3,065,473 | Sporck et al. | Lavatory with Built-In Water Heater |
| 3,508,282 | Phillips, Jr. | Lavatory Unit |
| 3,639,920 | Griffin et al. | Programmed Plumbing Service |
| 3,992,730 | Davis | Scrub Sink |

SUMMARY OF THE INVENTION

The present invention comprehends an improved hand washing and drying device including a bowl defining a hand washing and drying space. The device further includes means for delivering hand washing water and hand drying air to the bowl space. Both of the water delivering means and the drying air delivering means are mounted to the bowl for facilitated construction of the device. The invention is also disclosed in copending U.S. application Ser. No. 866,175, of Lester H. Hinkel and Lawrence E. Wolske entitled "Automatic Hand Washer and Drier" filed, Dec. 30, 1977, now abandoned, and owned by the assignee hereof.

More specifically, the invention comprehends providing integral means on the bowl for supplying both of the water supplying means and drying air supplying means. In the illustrated embodiment, the bowl is provided with integral bosses for supporting the auxiliary apparatus.

The water supplying means may include a tank and means for heating washing water in the tank. The invention comprehends the mounting of the tank to the bowl and in the illustrated embodiment, suitable bracket means are provided for removable mounting of the tank to an integral mounting portion of the bowl.

The air drying means may include a motor-driven blower which may be mounted to suitable integral means of the bowl.

The water delivery means includes an outlet mounted in an opening formed in the rear wall of the bowl and the air drying means includes an outlet formed in the rear wall of the bowl.

The water heating means may include a heater for heating water in the tank, as shown in the illustrated embodiment.

The flow of water to the tank and from the tank to the outlet in the bowl may be controlled by a solenoid-operated valve, which solenoid-operated valve may be mounted to structure attached to the bowl.

The subassembly of the bowl and auxiliary apparatus may be enclosed in a removable cabinet, or housing. The housing may be arranged to be mounted to a hanger removably secured as to a wall so as to provide facilitated wall mounting of the device.

The housing may include rear hook portions adapted to be hooked to the hanger in supporting the housing and subassembly thereto.

Means, such as screws, may be provided for preventing lifting of the housing and enclosed subassembly from the hanger.

The housing and hanger may include cooperating side shoulder portions for precluding lateral displacement of the housing on the hanger.

In the illustrated embodiment, threaded securing means may be provided for removably securing the subassembly to the housing.

The housing may be provided with a removable front panel for providing access to the subassembly elements within the housing as for servicing the same.

In the illustrated embodiment, the housing includes a plurality of vertically spaced hooks and the hanger includes a corresponding plurality of hook-engaging portions for supporting engagement therewith in the installed arrangement of the device.

The device may include a soap dispenser having a dispensing portion and means for mounting the soap dispenser to the housing with the dispensing portion overlying the bowl space.

The control switch means for automatically actuating the hot water supply and drying air supply may be mounted to the support above the rear of the bowl for facilitated engagement thereof by the user's hands during the washing and drying operation. The automatic operation of the device and the controls employed in the automatic operation of the device are described in detail in copending U.S. application Ser. No. 866,172 of Thomas R. MacFarlane and Richard G. Sickert entitled "Automatic Hand Washing and Drying Apparatus" filed Dec. 30, 1977, now U.S. Pat. No. 4,145,769, and copending U.S. application Ser. No. 866,173, of Thomas R. MacFarlane and Richard G. Sickert entitled "Water Supply Control for Automatic Hand Washing and Drying Apparatus" filed Dec. 30, 1977, now U.S. Pat. No. 4,144,569, both applications being owned by the assignee hereof.

Thus, the hand washing and drying device of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 6 is a rear perspective view of the bowl for the hand washing and drying device of the present invention;

FIG. 7 is a fragmentary vertical section taken substantially along the line 3—3 of FIG. 2, with the cabinet and other structure omitted to illustrate details of the warm water supply for the washing and drying device embodying the invention;

FIG. 8 is a fragmentary vertical section taken substantially along the line 4—4 of FIG. 2, with the cabinet and other structure ommitted to illustrate details of the hand drying air supply for the washing and drying device embodying the invention; and FIG. 9 is an exploded perspective view of the housing and hanger prior to the assembly thereof.

DESCRIPTION OF THE PREFERRED EMBODIMENT

Figure 2:
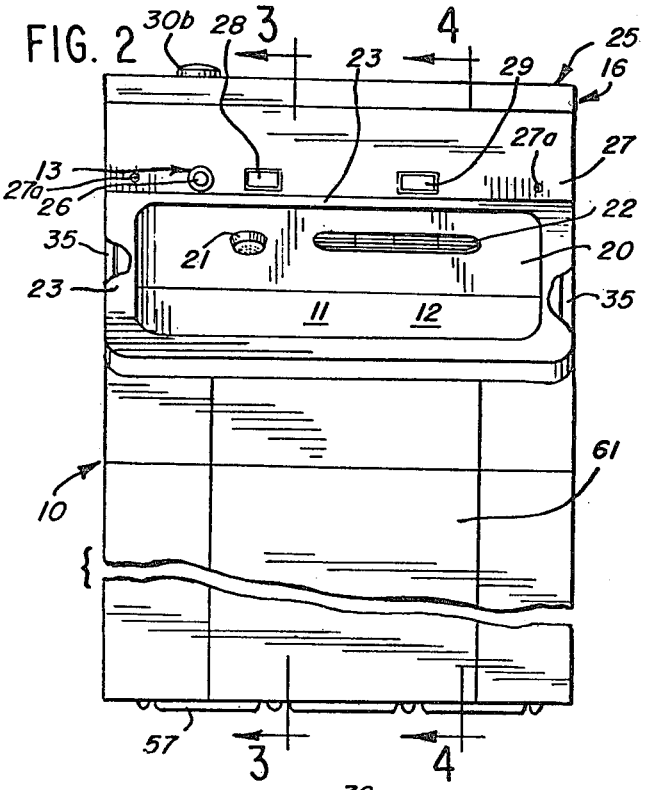
FIG. 2 is a front elevation thereof.

In the exemplary preferred embodiment of the invention as disclosed in the drawing, a hand washing and drying device generally designated 10 is shown to include a bowl 11 defining a hand washing and drying space 12.

The ornamental design of the preferred embodiment of the invention is disclosed and claimed in copending U.S. patent application Ser. No. D866,174 of Lawrence E. Wolske entitled "Multi-Purpose Plumbing Fixture Bowl and Cabinet Assembly", filed Dec. 30, 1977, now U.S. Pat. No. D261,420 and owned by the assignee hereof.

The device 10 is recessed so that the rear surface of the bowl 11 projects inwardly to provide a partially enclosed space to receive the hands for the washing and drying operation. The device includes means provided for supplying hand washing material, including a soap dispenser 13 and a warm water supply 14. Means 15 are provided for supplying hand drying air. The bowl is mounted in a cabinet 16 which, as shown in FIG. 1, is arranged to be mounted to a suitable wall 17, as shown in FIG. 3 in vertically spaced relationship to a subjacent floor 18.

Figure 1:
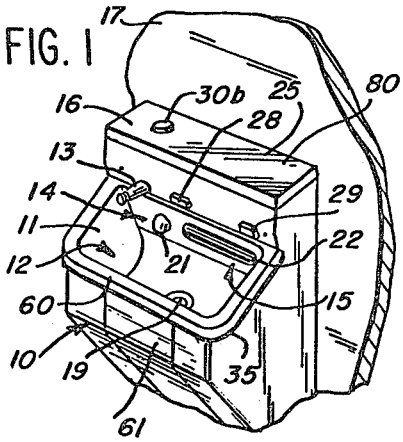
FIG. 1 is a fragmentary perspective view illustrating the mounting of the washing and drying device embodying the invention on a room wall.

As shown in FIG. 1, the bowl 11 defines a lower drain 19 for discharging spent washing water and soap from the device. The drain, as illustrated in FIG. 1, may be centrally located in the bottom of the bowl. As further illustrated in FIGS. 1, 2, 3, 4, 7 and 8, the bowl defines a concave rear wall 20 having a relatively flat rear surface **20*a* on which is mounted a warm water outlet 21 of the warm water supply 14 and a drying air outlet 22 of the hand drying air supply 15. Bowl rear surface 20*a* has formed therein an opening 21*a* for warm water outlet 21 and an opening 22*a* for air outlet 22. As shown, the outlets 21 and 22 may be disposed adjacent the upper rim 23 of the bowl. The water outlet 21 is placed at least 1" above the lower front edge of the bowl, thereby avoiding the need for a front edge drain to protect against siphoning of waste water into the fresh water supply. The concave rear wall 20 provides a recess 20*b* in bowl 11** so that the hands may be partially enclosed to facilitate an efficient use of the warm water and warm air during the hand washing and drying operation.

Figure 3:
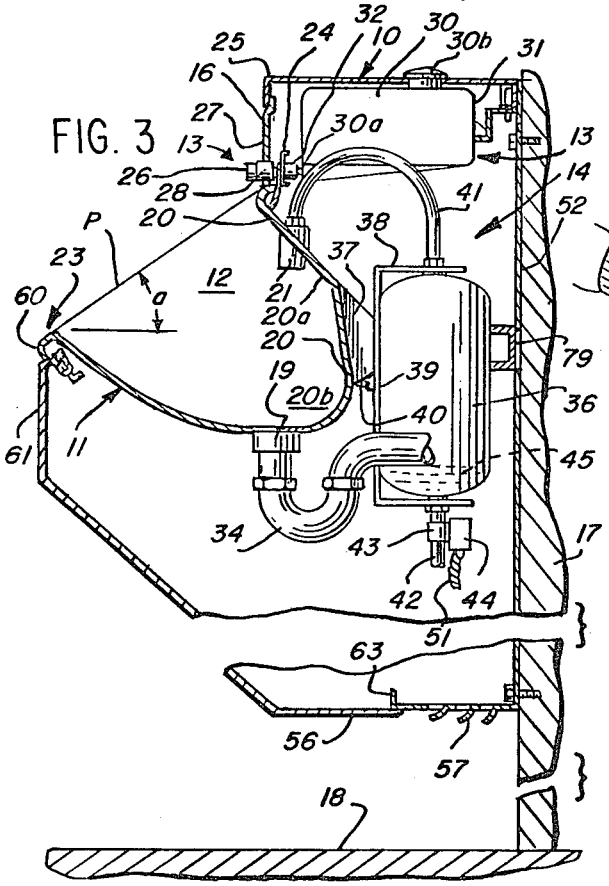
FIG. 3 is a fragmentary vertical section taken substantially along the line 3—3 of FIG. 2.

As shown in FIG. 3, the cabinet includes an outer cover portion 25. The soap dispenser 13 is provided with a manual operating means 26 extending forwardly through the front 27 of the cabinet 16 at the left side thereof, as best seen in FIG. 2. A manually operable control in the form of a push button 28 may be provided in the front portion 27 above the warm water outlet 21 for controlling the delivery of warm water therethrough. A similar manually operable push button control 29 may be mounted in the cabinet portion 27 above the warm air outlet 22 for controlling the delivery of hand drying air to the outlet 22. As shown in FIG. 2, the controls 28 and 29 are disposed on an easily reached front portion of cabinet 16 substantially at the level of the top portion of rim 23 for effective actuation thereby with the user effectively maintaining his hands within the bowl space 12 in the automatic operation and use of the device.

Figure 4:
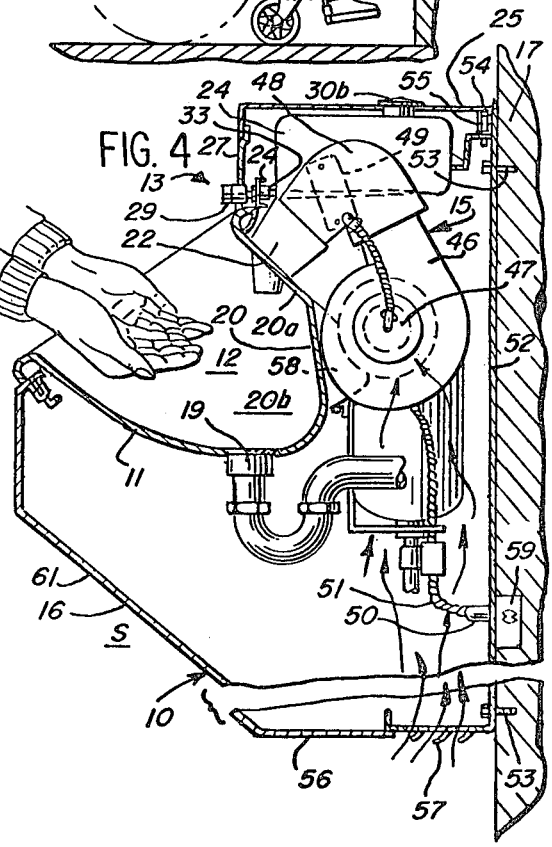
FIG. 4 is a fragmentary vertical elevation taken substantially along the line 4—4 of FIG. 2.

As shown in FIGS. 3 and 4, warm water outlet 21 and drying air outlet 22 are directly downwardly into the bowl space 12. As these outlets are displaced laterally from the drain 19, they direct the fluids delivered therefrom into the space and then along the surface of the bowl. Since the entire hand washing and drying operation takes place within the confines of the bowl, its walls substantially prevent the warm water and warm air from spilling outside the bowl before passing over the hands, maximizing efficient use of the warm water and warm air.

As shown in FIGS. 3 and 4, the soap dispenser 13 may include a reservoir 30 mounted within the cabinet 16, which is supported at the front by a hose 30*a* which connects reservoir 30 to dispenser 13 and at the rear by a support formed in the rear wall of the reservoir which rests on a flange projecting from a rear support member of cabinet 16. Soap is added to reservoir 30 through an opening in outer cover portion 25 which is closed by a soap dispenser cap 30*b*. As shown in FIG. 3, the warm water control 28 operates a control switch 32 carried on support 24 rearwardly of the front 27, and as shown in FIG. 4, the control 29 operates a switch 33.

As shown in FIG. 3, the drain 19 may be connected to a sewer line or the like through a conventional drain trap 34. In the illustrated embodiment, rim 23 of the bowl rests on suitable flanges 35 of the cabinet and is supported by the cabinet rather than by the drain trap which is slidably connected to drain 19, as shown in FIG. 3.

Warm water supply 14 further includes a water heating tank 36 which is carried on bosses 37 of the bowl 11 by means of a suitable bracket 38 on tank 36 and mounting bracket 39 secured to boss 37 by suitable threaded securing means, such as bolts 40 (FIGS. 3 and 7). The top of the heating tank is connected to the hot water outlet 21 by a suitable duct 41 and the lower end of the tank is connected to a cold water supply line 42 through a valve 43 controlled by a suitable electric solenoid 44.

As shown in dotted lines in FIG. 3, heating tank 36 may be provided in its lower portion with a conventional electrically energized immersion heating coil 45 for heating the water in tank 36 to a preselected hand washing temperature, say 105° F. (approximate). The immersion of coil 45 in the water in tank 36 ensures an efficient heat transfer relationship between the heating coil and the water. The heating coil is preselected to permit an effective continuous operation of the hand washing and drying device, i.e., by successive persons such as in continuous public restroom or washroom use.

As shown in FIGS. 4 and 8, the hand drying air supply 15 further includes air moving means including blower 46 driven by a suitable electric motor 47. The blower delivers the hand drying air to a duct 48 in which is provided an electric heater 49 for suitably warming the hand drying air before discharge thereof through the air outlet 22 in the bowl rear wall 20.

As further shown in FIG. 4, device 10 may be electrically energized through a conventional electrical connector plug 50 from which the power cord 51 extends to the different electrical devices within the apparatus.

Cabinet 16 may be hung to the wall 17 by means of a hanger 52 which may be secured to the rear wall by suitable screws 53 (FIG. 4). The cabinet may include upper hooks 54 adapted to engage suitable mounting bracket means 55 of the hanger 52 to carry the cabinet on the hanger. As shown in FIG. 4, the cabinet may include a bottom wall 56 provided with suitable air inlet louvers 57 for permitting air to be drawn upwardly from adjacent floor 18 (FIG. 3) into the cabinet 16 for delivery by blower 46 through the air outlet 22 into the bowl space 12.

Figure 5:
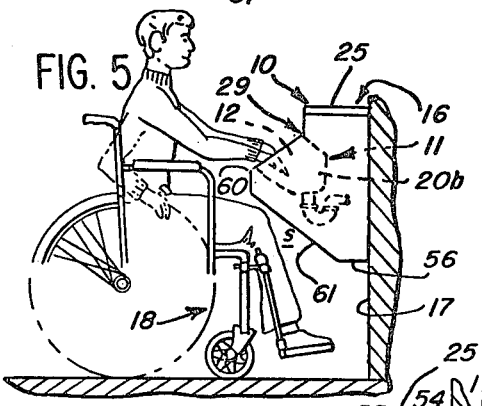
FIG. 5 is a fragmentary side elevation view, partially in section, illustrating the apparatus of the present invention in use by a person in a wheelchair.

As further shown in FIGS. 4, 5 and 7, blower motor 47 may be mounted to bowl 11 by means of bosses 58. Thus, in the illustrated embodiment, both the warm water supply means 14 including the warm water outlet 21 and the air drying means 15 including the air outlet 22 are supported by the bowl. This is a major advantage of the present invention. In the manufacture of the device of the present invention, the warm water supply structure (FIG. 7) and the hand air drying structure (FIG. 8) are mounted on the bowl structure (FIGS. 6, 7 and 8) with the warm water supply connection from the tank to the bowl and the hand drying air supply from the blower to the bowl complete in place, to form an integral unitary subassembly which can be completely assembled at the factory. This facilitates an energy efficient, economical installation by minimizing the length of warm water and warm air conduits, and eliminating any need for mounting a plurality of components on wall structure at the point of use of the hand washer and drier, and then making water and air connections from the wall mounted components to the bowl. This helps to minimize installation costs for the hand washing and drying device of the present invention.

In the illustrated embodiment, the cabinet includes a removable front panel 61 permitting access to the space below bowl 11 within the cabinet such as for servicing the apparatus within the lower portion of the cabinet without the need for removing the entire device from the hanger 52.

As shown in FIG. 4, the electrical connector plug 50 may be arranged to be plugged into a conventional wall receptacle power outlet 59, permitting the device to be installed without requiring special electrical service. The provision of the connector plug 50 and the cabinet enclosure further provides the highly desirable feature of covering the outlet 59, precluding unauthorized access to the electrical power supply once the device is installed on wall 17, as shown in FIG. 4.

As thus seen in FIG. 3, rim 23 of the bowl 11 effectively defines a plane p extending at an angle a of 35° with respect to the floor level. The rim, as shown in FIG. 3, is relatively narrow. The front edge portion 60 of the rim is disposed above the floor 18 level approximately 37 inches (0.94 meters). In contrast, conventional lavatories and vanities are arranged with a substantially horizontal rim portion disposed in the range between 28 inches (0.711 meters) and 31 inches (0.787 meters) above floor level, and conventional urinal heights measure approximately 24 inches (0.609 meters) from the floor to the lip. Thus, the device of the present invention is arranged in the installation thereof, as shown in FIG. 3, to deter the use thereof as a urinal and effectively deter persons from sitting on the device and thereby putting undue strain on the wall mounting means.

An important feature of the present invention is the wall mounting of the cabinet so that it projects laterally from the wall, with a provision of space below the lower front edge of the bowl, facilitating use of the hand washer-drier as by handicapped persons in wheelchairs, as shown in FIG. 5. The portion of the cabinet which includes removable front panel 61 slopes back from the bowl front edge portion 60 to provide a substantial space s in front of the lower portion of the cabinet, and bottom wall 56 is spaced substantially above the floor level. Therefore, a person in a wheelchair can roll up to and clearly approach the front of the hand washing and drying apparatus and easily manipulate the frontally accessible warm water and warm air controls 28 and 29 and wash and dry the hands within the frontally accessible recessed bowl, all without any undue reaching or strain, as shown in FIG. 5. Front portions of the wheelchair and the user's feet and legs can fit underneath front portions of the hand washer and drying apparatus cabinet 16 to facilitate the hand washing and drying operations by a user seated in a wheelchair, as shown in FIG. 9.

The temperature of the water heated in tank 36 is preselected to be the proper 105° F. temperature for effectively washing the user's hands while not being so hot as to cause injury. Thus, a single water outlet is utilized. By the simple arrangement shown in FIGS. 1 and 2, the operation of the device is essentially obvious to the normal user. Thus, the normal operation of the soap dispenser is conventional and thus obvious, and as the water control is disposed substantially directly above the warm water outlet, the use and functioning of these portions of the device will also be obvious to the normal user. Similarly, the disposition of the air drier control, button 29, directly above the air outlet 22, causes the functioning thereof to be obvious to the normal user. If desired, however, additional legends or suitable additional indicia may be employed.

The hand washing and drying device of the present invention is extremely simple, while yet providing an improved hand washing and drying functioning automatically and with minimum energy usage as the maintenance of the user's hands in the bowl during the soaping, washing, rinsing, and drying operations provides optimum utilization of the washing material and hand drying air. Further, as a result of the improved directing of the washing material and hand drying air into the bowl from outlets mounted in the rear wall thereof, an improved sanitized condition of the bowl surface is obtained. Concomitantly, by eliminating flat surfaces adajcent to the narrow rim of the bowl, collection of dirty water and the like is further avoided.

Additionally, the device is readily installed by means of the hanging thereof on the previously mounted hanger simply secured to the wall by means of the mounting screws 53. The automatic covering of the power supply as a result of the installation of the device on the wall provides additional protection against tampering with the power supply in a novel and simple manner.

Referring now to FIG. 9, the cabinet includes a front strap 60 adapted to mount the manual operating means 26 of the soap dispenser, the push button control 28 of the hot water supply, and the push button control 29 of the drying air supply. The disclosed arrangement provides a sturdy mounting of these elements providing facilitated accessibility thereto as for servicing and the like.

The cabinet defines a front opening 62 which is removably closed by the front panel 61, as shown in FIG. 2. Bottom wall 56 of the cabinet is provided with an upstanding flange 63 reinforcing the bottom wall and dividing the louver portion 57 from the front portion of the cabinet bottom.

As indicated briefly above, the cabinet defines a plurality of downwardly extending hooks 54 for engagement with the bracket 55 of hanger 52. As shown in FIG. 9, the hooks include a pair of relatively large center hooks 64 and an outboard pair of smaller hooks 65 each of which is downturned from a rear strap 66 of the cabinet.

Additionally, the cabinet is provided with a pair of lower hooks 67 spaced substantially below the upper hooks 64 and 65. Upper hooks 64 and 65 hook over the upper bracket 55, as discussed above, and the lower hooks 67 are engaged with the upright side support 68 of the hanger in suitable openings 69 therein.

As shown in FIG. 9, hanger 52 effectively defines an A-frame having a lower cross brace 70 parallel to and spaced substantially below the upper bracket 55.

The rear of the cabinet defines a pair of inturned flanges 71 and a pair of rearwardly extending flanges 72. Hooks 67 are provided in a midportion of the inturned flanges 71. Adjacent to the hook 67, the inturned flanges are provided with suitable openings 73 for passing suitable securing screws 74 into secured relationship with threaded openings 75 in the lower portion of the hanger upright 68. Directly below opening 73, the side flanges 71 are provided with a pair of lowermost hooks 76 which are adapted to be received in suitable openings **77*a* in the lower end of the upright 78. Thus, screws 74 lock the housing to the hanger when hooks 64 and 65 are hooked over bracket 55 and hooks 67 and 76 are hooked into the openings 69 and 77*a* of the uprights 68 to secure the housing to the hanger against upward removal therefrom. The side flanges 72 embrace the side edges 77 of the hanger so as to prevent lateral displacement of the cabinet on the hanger in the installed arrangement of FIGS. 1 and 2**.

As further shown in FIG. 9, uprights 68 may be provided with suitable open bosses 78 for passing the screws 53 therethrough in mounting the hanger 52 to the wall 17, as shown in FIG. 3.

The rear of the cabinet may be reinforced by a cross channel 79.

In assembling device 10, the major components, including the blower 46, blower motor 47, warm water tank 36, electric heater 45, solenoid-operated valve 43, water outlet 21, and drain 19 are assembled to the bowl as discussed above. This subassembly is then secured in the cabinet, as shown in FIGS. 3 and 4. The cabinet comprises a spot-welded assembly of panels forming a rigid outer housing structure 90 having the removable front panel 61 readily installed and removed as desired. Front strap 60 may be secured to the cabinet as by suitable screws or the like, permitting the soap dispenser actuator and control push buttons to be mounted thereto, as illustrated in FIG. 2. The cabinet includes a top cover portion 83 which may be secured to the main portion of the cabinet as by suitable screws.

Hanger mounting screws 53 may comprise conventional lag screws, toggle bolts, etc. The hanger is secured to the wall in the desired location by the screws 53 and it is then hung on the hanger by means of the hooks as discussed above which effectively prevent the cabinet assembly from being pulled forwardly away from the hanger end wall. The side flanges effectively preclude lateral displacement and the screws 74 effectively lock the cabinet to the hanger in the assembled arrangement.

The foregoing disclosure of a specific embodiment is illustrative of the board inventive concepts comprehended by the invention.

The embodiments of the invention in which an exclusive property or privilege is claimed are defined as follows:

1. A hand washing and drying device comprising:

a bowl defining a hand washing and drying space, a backside and first and second openings;

means for supplying hand washing material to said space including a water heating tank having an outlet, said water heating tank being mounted to said backside with said outlet opening through said first bowl opening;

air moving means including a motor-driven blower, said air moving means including said blower being mounted as a unit to said backside of said bowl, said air moving means further including an outlet received in said second bowl opening to open to said space for supplying hand drying air to said space to permit sequential washing and drying of a user's hands in said space;

means for supporting the assembled bowl and mounted;

and wherein said bowl backside defines first and second mounting bosses and said air moving means is mounted to said first mounting boss and said water heating tank is mounted to said second mounting boss to form therewith an integral unitary subassembly.

2. The hand washing and drying device of claim 1 further including a housing removably enclosing said subassembly and a hanger removably mounting said housing and subassembly, said housing and hanger including cooperating side shoulder portions for precluding lateral displacement of the housing on the hanger.

3. The hand washing and drying device of claim 1 further including a housing removably enclosing said subassembly, said housing including a removable front panel for providing access to the elements within the housing as for servicing the same.

4. The hand washing and drying device of claim 1 further including a housing removably enclosing said subassembly, said housing including a support member, said device further including a soap dispenser having a dispensing portion and means for mounting the soap dispenser to said housing with said dispensing portion overlying said bowlspace.

5. The hand washing and drying device of claim 1 wherein said mounting bosses are juxtaposed.

6. The hand washing and drying device of claim 1 wherein electrical water heating means are immersed in said tank to be carried by said second mounting boss with said water heating tank.

7. The hand washing and drying device of claim 1 wherein electrically operable solenoid valve means are provided for controlling delivery of water to said water heating tank, said solenoid valve means being mounted to said tank to be carried by said second mounting boss with said tank.

8. The hand washing and drying device of claim 1 wherein said air moving means includes an air heating means, also supported with said blower as a unit by said first mounting boss.

9. The hand washing and drying device of claim 1 wherein said air moving means includes a duct mounting said air heating means to said bowl.

10. The hand washing and drying device of claim 1 further including a housing removably enclosing said bowl, said air moving means defining a rearwardly opening recess, and further including a hanger for removably supporting said housing and enclosed bowl and air moving means, said hanger being received within said recess so as to be hidden in the mounted arrangement of the device.

11. The hand washing and drying device of claim 10 wherein said housing includes hooks hooked onto said hanger for supporting said housing and enclosed bowl and air moving means.

12. The hand washing and drying device of claim 11 further including threaded securing means for securing the housing to said hanger to prevent lifting of said hooks therefrom.

* * * * *

UNITED STATES PATENT AND TRADEMARK OFFICE

CERTIFICATE OF CORRECTION

PATENT NO. : 4,336,619

DATED : June 29, 1982

INVENTOR(S) : Lester H. Hinkel and Robert M. Chandler

It is certified that error appears in the above-identified patent and that said Letters Patent are hereby corrected as shown below:

Column 9, line 40 (Claim 1, line 18), after "mounted", insert --water heating tank and air moving means--.

Signed and Sealed this

*Fifth* Day of *October 1982*

[SEAL]

*Attest:*

GERALD J. MOSSINGHOFF

*Attesting Officer*

*Commissioner of Patents and Trademarks*